United States Patent [19]

Schmid et al.

[11] Patent Number: 4,531,033

[45] Date of Patent: Jul. 23, 1985

[54] KEYBOARD FOR INITIATING SWITCHING OPERATIONS OR SWITCHING SIGNALS ASSOCIATED WITH RESPECTIVE SYMBOLS ON THE SURFACES OF THE KEYS

[75] Inventors: Theobald Schmid, Munich; Horst Widmaier, Grosshesselohe; Friedrich Wolf, Planegg, all of Fed. Rep. of Germany

[73] Assignee: Hand Widmaier Fabrik Fur Apparate Der Fernmelde-und Feinwerktechnik, Munich, Fed. Rep. of Germany

[21] Appl. No.: 491,894

[22] Filed: May 5, 1983

[30] Foreign Application Priority Data

Feb. 1, 1983 [DE] Fed. Rep. of Germany ... 8302660[U]

[51] Int. Cl.[3] ..... H01H 9/16

[52] U.S. Cl. ..... 200/314; 200/5 A; 200/159 B; 200/340

[58] Field of Search ..... 200/310, 313, 314, 317, 200/159 B, 5 A, 340; 340/365 R, 365 S

[56] References Cited

U.S. PATENT DOCUMENTS

| | | | |
|---|---|---|---|
| 2,261,115 | 11/1941 | Hofgaard | 235/145 R |
| 2,730,248 | 1/1956 | Van Waert | 400/100 X |
| 4,060,703 | 11/1977 | Evert, Jr. | 200/313 |
| 4,092,777 | 8/1977 | Bequaert et al. | 340/365 R X |
| 4,129,758 | 12/1978 | Gilano et al. | 200/5 A |
| 4,322,587 | 3/1982 | Burns et al. | 200/159 B |
| 4,366,355 | 12/1982 | Oelsch | 200/159 B |
| 4,367,384 | 1/1983 | Waarle | 200/159 B |
| 4,400,593 | 8/1983 | Kunz | 200/5 A |

FOREIGN PATENT DOCUMENTS

| | | | |
|---|---|---|---|
| 700140 | 12/1940 | Fed. Rep. of Germany . | |
| 1107534 | 5/1961 | Fed. Rep. of Germany . | |
| 3020010 | 12/1981 | Fed. Rep. of Germany | 200/159 B |
| 2066575 | 6/1981 | United Kingdom | 200/317 |

OTHER PUBLICATIONS

IBM Tech. Disc. Bull. vol. 13, No. 11, Apr. 71.

*Primary Examiner*—Stephen Marcus
*Assistant Examiner*—Ernest G. Cusick
*Attorney, Agent, or Firm*—Baker, Maxham, Callan & Jester

[57] ABSTRACT

A keyboard for initiating switching functions or switching signals. Synchronizing pins coupled to four key members at the mutually adjacent crossing between them cause actuation of contact sets upon depression of the keyboard surface above each synchronizing pin. Actuation of at least two contact sets are necessary to initiate a switching function corresponding to the keyboard symbol at the position of surface depression. A light may be employed to visually indicate the symbol actuated.

4 Claims, 2 Drawing Figures

KEYBOARD FOR INITIATING SWITCHING OPERATIONS OR SWITCHING SIGNALS ASSOCIATED WITH RESPECTIVE SYMBOLS ON THE SURFACES OF THE KEYS

FIELD OF THE INVENTION

This invention relates to a keyboard for initiating switching operations or switching signals associated with respective symbols on the surfaces of the keyboard.

BACKGROUND OF THE INVENTION

In such a keyboard known from German patent application 27 29 157, each symbol of the keyboard has associated with it a plurality of keys which are disposed in a plane, at least two of which serve to actuate respective contact sets of an electric contact array in such a manner that the actuation of the contact sets associated with one symbol will initiate the switching operations which are associated with that symbol. Specifically, a particular symbol of the keyboard is associated with each crossing of the gaps between adjacent rows and columns of keys so that each symbol is associated with four keys which constitute a square array. With the condition stated above that each of the gap crossings is associated with one symbol, each key other than the keys at the edges of the keyboard can be used for key actuations associated with four different symbols.

With a view to a simple design of the means for logically combining the contact sets to be actuated and to a reliable operation of that means, it is desirable in such a keyboard that the contact sets associated with a given symbol be actuated simultaneously and that the design of the key-guiding means and synchronizing means required for this purpose should not be unduly complicated.

SUMMARY OF THE INVENTION

For these reasons it is an object of the invention to provide a keyboard in which the above requirements are met, which is simple in design and clearly arranged and can be assembled in a particularly simple manner.

More specifically, the keyboard permits the use of contact arrays which comprise a switch-actuating elastic diaphragm, a contact set carrier plate facing the diaphragm, and means to actuate snap-action elements. Each snap-action element has a conductive bridging element which makes contact with the conductor path patterns on the contact set carrier plate. The movement of the plungers for actuating the contacts is positively guided so as to ensure a reliable switch actuation.

The keys include cylindrical guide stems which are guided in associated guiding bores of a matrix structure. The keyboards have laterally protruding flanges formed with recesses in such a manner that there is an aperture at each crossing of the gaps between adjacent rows and columns of keys. Synchronizing pins are movably fitted in these apertures. An elastic covering film or layer over the keyboards and pins is provided at its upper surface with imprinted symbol fields. The covering film also functions to retain the synchronizing pins in place with respect to the keyheads. With this assembly there is no need for the synchronizing pins to have elongated extensions or spring biasing means in order to maintain their structural relationship and function in the keyboard. The synchronizing pins designed and retained in the manner described have a comparatively small axial length, ensure an adequately synchronized actuation of the keys, and are tiltable to some extent. That tiltability improves the reliability in operation.

The synchronizing pins and, if desired, the elastic covering film or covering layer, may be made at least in part of transparent material. The guide matrix structure is formed between the guiding bores with apertures which accommodate miniature signal lamps associated with the respective symbols.

BRIEF DESCRIPTION OF THE DRAWING

The objects, advantages and features of the invention will be more readily appreciated from the following detailed description, when read with reference to the accompanying drawing, in which.

DESCRIPTION OF THE PREFERRED EMBODIMENT

Figure 1:
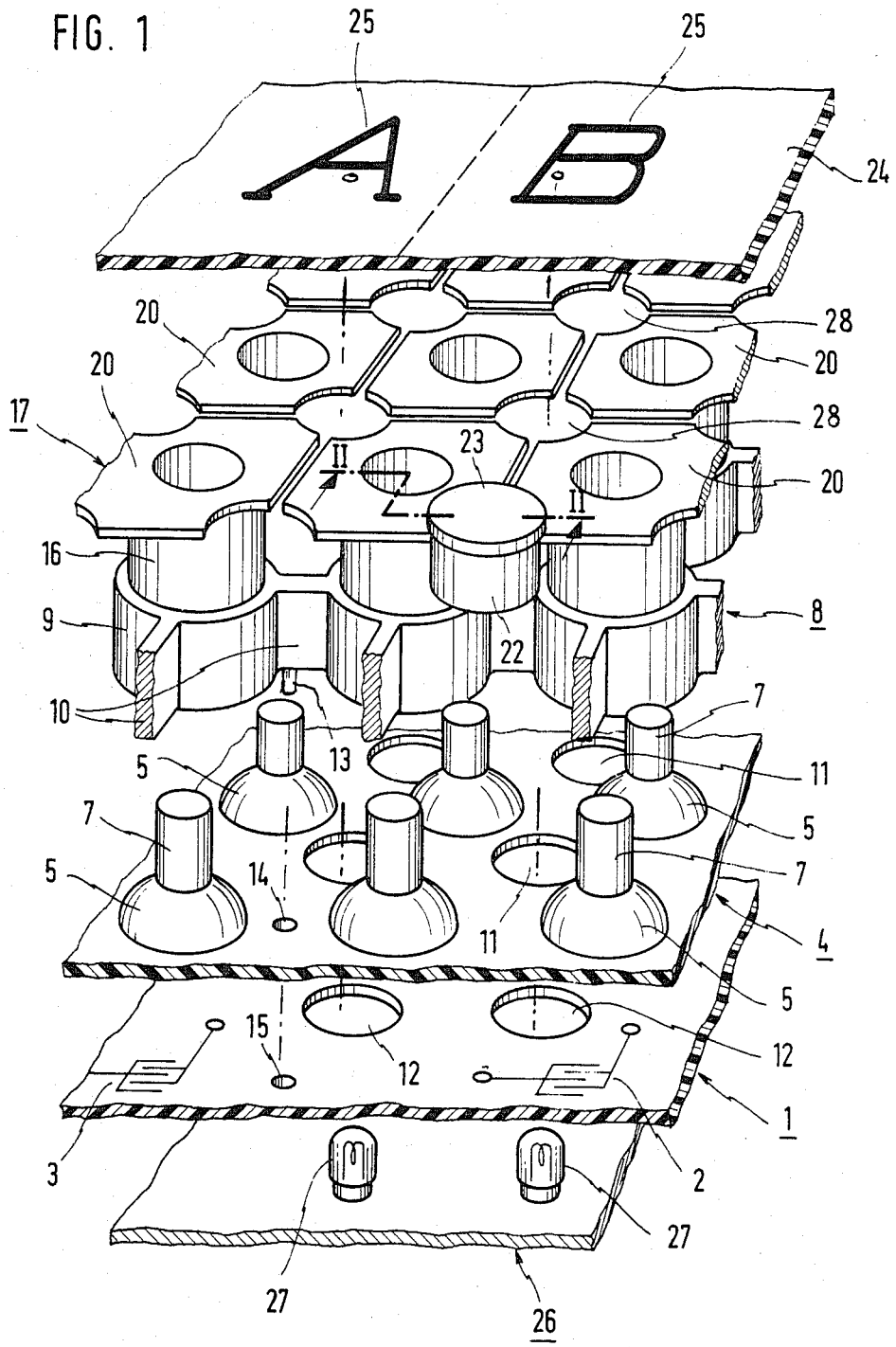
FIG. 1 is an exploded fractional perspective view showing the keyboard of this invention.

With reference now to the drawing, FIG. 1 shows clearly how the keyboard is assembled by stacking plate-like elements. The assembled relative positions of the several components are apparent from FIG. 2. It is pointed out that means for clamping the entire stack together are not shown in the drawing. It is understood that the entire keyboard is surrounded by a frame, which may constitute a part of a housing, particularly a liquid-tight housing.

The keyboard comprises a contact set carrier plate 1 of rigid insulating material. Conductive paths consisting of pairs of fanlike conductors arranged in regions 2, 3 which paths interdigitate but do not contact each other, are provided on the contact set carrier plate in a regular repetitive pattern. Leads extend from the conductor paths to contact rivets which make an electrical connection to a pattern of leads provided on the underside of the contact set carrier plate 1. Details of the conductor patterns which are to be provided on the contact set carrier plate, and consist of printed circuits, are known to persons skilled in the art and need not be described here in detail. It is also not necessary to describe how conductor paths on the contact set carrier plate extend to contact pins carried by said plate.

A switch-actuating diaphragm 4 made of an elastically yielding material is disposed over the contact set carrier plate 1. The switch-actuating diaphragm comprises a regular array of snap-action cup portions 5, each of which carries on its inside surface, facing the contact set carrier plate, a bridging element 6 (FIG. 2), which may consist, for example, of an elastic conductive plastic material. On the side extending away from the bridging element, each snap-action cup portion 5 is integrally formed with a plunger 7. The plunger serves to actuate the associated contact set and is substantially cylindrical and when depressed causes the associated cup portions 5 to be inwardly and downwardly deformed by a snap action. When the contact set carrier plate 1 and the switch-actuating diaphragm 4 lie directly on each other and are clamped together, the inward deformation of snap-action cup portion 5 causes the bridging element 6 provided on the inside of the cup portion to contact the underlying region 2 or 3 so as to bridge the interdigitating fanlike conductor elements of the associated conductive paths. A conductive path region together with a bridging element 6 is referred to as a contact set.

It may be observed here that a region 2, 3 of the contact set carrier plate 1 need not be provided under each snap-action cup portion 5. In a checkerboard pattern, a conductive path region may be associated only with each of alternate cup portions. In the present keyboard, the switching functions of those contact sets which are associated with diagonally opposite cup portions of each square array of four cup portions may be combined by an AND logic so that a definite output signal will be generated if a certain group of keys forming a square array associated with a desired symbol are depressed. With this structure, it requires the actuation of two contact sets to initiate a switching function.

A gridlike guide matrix structure 8 is mounted on the elastic switch-actuating diaphragm 4 and consists of a dimensionally stable, insulating material, typically made of a plastic. The guide matrix structure 8 is composed of a large number of substantially cylindrical guiding elements 9 equal in number to the snap-action cup portions 5. The guiding elements are interconnected by integrally formed webs 10, and the guiding elements are connected in such a manner that any four of them forming a square array define between them in the guide matrix structure 8 a free space. This free space is disposed above and vertically aligned with an associated aperture 11 in the switch-actuating diaphragm 4 and an aperture 12 in the contact set carrier plate 1.

To simplify the illustration, only a few guiding elements 9 and small portions of the switch-actuating diaphragm 4 and of the contact set carrier plate 1 are shown in FIG. 1. A person skilled in the art will recognize that these components are provided throughout the keyboard in regular fashion, and to any desired combination of rows and columns.

Depending fixing pins 13 are integrally formed with the guide matrix structure 8, particularly with some of the webs 10 thereof, and extend through bores 14 and 15 of the switch-actuating diaphragm 4 and of the current set carrier plate 1. These pins hold the components 1, 4 and 8 in alignment with each other so that it is ensured that each bridging element 6 is disposed vertically over the associated region 2, 3 of the contact carrier plate.

Figure 2:
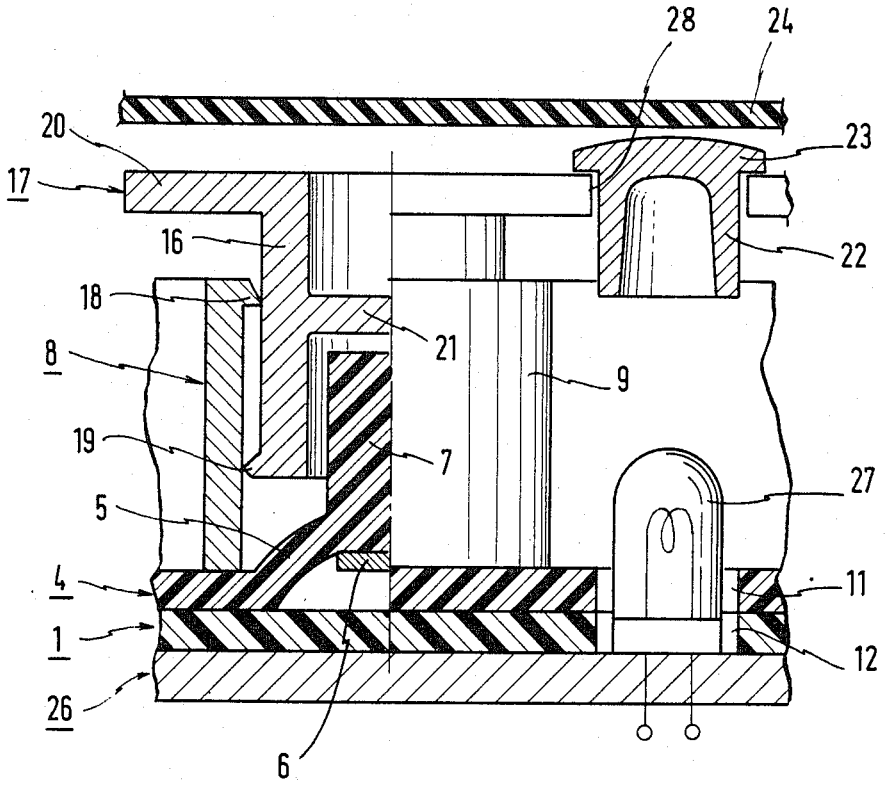
FIG. 2 is a sectional view taken on line 2—2 of FIG. 1.

The inside diameter of each cylindrical guiding element 9 substantially agrees with the large outside diameter of the snap-action cup portions 5, as is apparent from the left portion of FIG. 2. The upstanding contact-actuating plunger 7 extends coaxially in the cylindrical guiding element so that an annular clearance is defined between the contact-actuating plunger and the inside surface of the guiding element 9. A plurality of key members 17 are provided, each of which comprises a depending tubular guide stem 16 extending into the clearance so that the key member is telescopically held and guided in the associated guiding element 9. Each guiding element may be formed in its inside surface with vertical guiding grooves which receive mating guiding ribs formed on the outside surface of the guide stem 16 of the associated key member 17 so that the latter will be non-rotatably held in the guide matrix structure 8. As is indicated in FIG. 2, detent projections 18 and 19 may be provided in that region to ensure that the key members 17 are captively held in the guide matrix structure 8 when they have been inserted into and locked in the guiding elements 9.

At the top end of the guide stem 16, each key member 17 has a flat keyhead 20, which laterally protrudes from the guide stem and is rectangular, typically square, in a top plan view so that the rows and columns of keys of the keyboard are separated by narrow gaps which form crossings at key intersections.

Each tubular guide stem 16 has a partition 21 which is normally closely spaced from the top end of the associated contact set actuating plunger 7. When a key member 17 is depressed, the partition 21 engages the top end of the actuating plunger and depresses the plunger and the cup portion 5 to such an extent that the bridging element 6 in a snap action engages the juxtaposed conductive paths of the contact set carrier plate. The snap action can be sensed at the keyhead 20 as a tactile back signal or sudden shift or change of state within the keyboard indicating the actuation of the contact set.

The tubular guide stem 16 occupies the annular clearance between plunger 7 and guiding element 9 so that the plunger for actuating the contact set is axially guided with sufficient accuracy during its actuation to avoid a possible unreliable actuation of the contact set. In normal operation the contact set actuating plunger 7 would tend to tilt as it is depressed toward its snap action position, but for the fact that it is guided and kept upright by its telescopic engagement within guide stem 16 and guiding element 9.

The flangelike keyheads 20 are provided at their corners with recesses having the shape of a sector of a circle so that a substantially circular aperture 28 is provided at each crossing of the gaps between the adjacent rows and columns of keys. A synchronizing pin 22 formed with flange 23 overlying the keyheads is freely movably held in each of these apertures. In an alternative embodiment the flanges may extend into steps formed at the edges of the sector-shaped recesses of the keyheads 20 so that the surfaces of the flanges 23 of the synchronizing pins 22 and the surfaces of the keyheads 20 lie in a common plane.

As a synchronizing pin 22 is depressed, the adjoining keyheads 20 cause the four associated key members 17 to move downwardly substantially at the same time. Because the key members 17 are precisely guided in a simple manner by the guiding elements 9, there is no need for an exact guidance of the synchronizing pins 22. It has been found that in each synchronizing pin the cylindrical portion which depends from the flange 23 need have only a relatively short axial length and may freely enter the space between the guiding elements 9. In accordance with the drawing, at least two of the key members have contact sets associated with them. It is necessary that both contact sets be actuated substantially simultaneously upon depression of one synchronizing pin, together with its four associated key members, in order to initiate a switching function.

An elastic covering film 24 lies over the surfaces of the keyheads 20 and the top ends of the synchronizing pins 22 and has inscription fields imprinted with the alpha-numeric symbols of the keyboard, as indicated by reference numeral 25 in FIG. 1. One of the symbol-carrying inscription fields provided on the surface of the elastic covering film is associated with each of the circular apertures 28 so that the several imprinted symbols have only a small spacing which corresponds to the spacing of the circular apertures 28, that is to the effective width of the key members 17. Nevertheless, the total area of the actuating surface which is available to the finger of the operator on the surface of the elastic covering film 24 and associated with a given symbol is equal to the area lying over the four keyheads 20 which adjoin the associated circular aperture 28. Upon depression of the symbol imprinted area, the corresponding synchronizing pin and key members are depressed to initiate a switching function.

The elastic covering film 24 does not only cover the inscription surface but may also constitute a liquid-tight cover over the entire keyboard. The elastic covering film also retains all synchronizing pins 22 in the apertures 28 and prevents those components from falling out of the keyboard during transport and handling.

Miniature signal lamps 27 in an array corresponding to the apertures 11 and 12 are mounted on a plate 26 disposed under the contact set carrier plate 1. The signal lamps extend through the apertures 11 and 12 into the spaces between the guiding elements 9 so that each signal lamp registers with one of the synchronizing pins 22, as is apparent from FIG. 2. As the synchronizing pins 22 and the elastic covering film 24 consist of transparent material, each of the signal lamps 27 can deliver a visual indicating signal, which will be transmitted by the associated synchronizing pin and appear on the associated inscription field of the elastic covering film 24, when the associated keys have been actuated. Details of the connections to the signal lamps 27 are not shown on the drawings and are known to a person skilled in the art.

In view of the above description, it is likely that modifications and improvements which are within the scope of the accompanying claims will occur to those skilled in the art.

What is claimed is:

1. A keyboard for initiating switching functions or switching signals, said keyboard having alpha-numeric symbols imprinted thereon and comprising:

an electrically insulative contact set carrier plate;

a plurality of conductive path regions arranged in a regular repetitive pattern on said carrier plate;

a guide matrix structure mounted above said carrier plate, said matrix having a plurality of guiding bores formed therein in a rectangle arrangement of rows and columns, said guide matrix structure being formed with apertures spaced from said guiding bores;

axially movable key means extending through and being guided within each of said guiding bores, said key means comprising:

an elastic switch actuating diaphragm in juxtaposition with said carrier plate;

a snap-action cup portion of said diaphragm normally spaced above said carrier plate;

a contact set actuating plunger integrally formed with said cup portion and extending upwardly therefrom; and a cylindrical guide stem positioned to engage said plunger;

an electrically conductive bridging element mounted to at least some of said key means, said bridging element being normally spaced from and in juxtaposition with one of said conductive path regions, each said bridging element and conductive path regions comprising a contact set, said bridging element being mounted to the side of said cup portion opposite said plunger for selective actuation of said contact set;

a keyhead extending laterally from each said key means and forming a gap separating said adjacent keyheads, each said keyhead being formed with a recess at each corner thereby forming an aperture at each crossing of the gaps between keyheads in the rows and columns;

a synchronizing pin freely axially movably mounted in each said aperture, said axial movement being parallel to the direction in which said key means are movable, each said synchronizing pin being formed with a flange engaging that portion of said keyheads surrounding said aperture so that axial movement of said synchronizing pin causes movement of all said key means forming said aperture;

an elastic covering layer over the tops of said keyheads and synchronizing pins, said layer being imprinted with symbol-carrying inscription fields, said symbols being the alpha-numerical symbols of said keyboard, one of said symbols being associated with each said aperture and synchronizing pin, said synchronizing pins and at least portions of said covering layer being substantially transparent; and a miniature signal lamp in said apertures, one said lamp being associated with each said symbol, said lamps being adapted to be connected so as to light upon depression of the respective symbol;

whereby when one of said symbols is depressed, all of the keys at that crossing are depressed and at least two of said contact sets are actuated to initiate a switching function associated with said depressed symbol.

2. The keyboard recited in claim 1 wherein said guiding bores and said key means are formed with mating detent projections and partly closed grooves to provide positive axial guiding and captive retention of said key means in said bores.

3. A keyboard for initiating switching functions or switching signals, said keyboard having alpha-numeric symbols imprinted thereon and comprising:

an electrically insulative contact set carrier plate;

a plurality of conductive path regions arranged in a regular repetitive pattern on said carrier plate;

a guide matrix structure mounted above said carrier plate, said matrix having a plurality of guiding bores formed therein in a rectangular arrangement of rows and columns, said guide matrix structure being formed with apertures spaced from said guiding bores;

axially movable key means extending through and being guided within each of said guiding bores;

an electrically conductive bridging element mounted to at least some of said key means, said bridging element being normally spaced from and in juxtaposition with one of said conductive path regions, each said bridging element and conductive path region comprising a contact set;

a keyhead extending laterally from each said key means and forming a gap separating said adjacent keyheads, each said keyhead being formed with a recess at each corner thereby forming an aperture at each crossing of the gaps between keyheads in the rows and columns;

a synchronizing pin freely axially movably mounted in each said aperture, said axial movement being parallel to the direction in which said key means are movable, each said synchronizing pin being formed with a flange engaging that portion of said keyheads surrounding said aperture so that axial movement of said synchronizing pin causes movement of all said key means forming said aperture;

an elastic covering layer over the tops of said keyheads and synchronizing pins, said layer being imprinted with symbol-carrying inscription fields, said symbols being the alpha-numerical symbols of said keyboard, one of said symbols being associated with each said aperture and synchronizing pin, said synchronizing pins and at least portions of said covering layer being substantially transparent; and a miniature signal lamp in said apertures, one said lamp being associated with each said symbol, said lamps being adapted to be connected so as to light upon depression of the respective symbol;

whereby when one of said symbols is depressed, all of the keys at that crossing are depressed and at least two of said contact sets are actuated to initiate a switching function associated with said depressed symbol.

4. The keyboard recited in claim 3 wherein said guiding bores and said key means are formed with mating detent projections and partly closed grooves to provide positive axial guiding and captive retention of said key means in said bores.

* * * * *